US008848005B2

(12) United States Patent
Chen

(10) Patent No.: US 8,848,005 B2
(45) Date of Patent: Sep. 30, 2014

(54) DISPLAY DEVICE AND DATA DRIVING CIRCUIT THEREOF, DRIVING METHOD OF DISPLAY PANEL AND DISPLAY SYSTEM

(71) Applicant: Novatek Microelectronics Corp., Hsinchu (TW)

(72) Inventor: Min-Jung Chen, Taipei (TW)

(73) Assignee: Novatek Microelectronics Corp., Hsinchu (TW)

( * ) Notice: Subject to any disclaimer, the term of this patent is extended or adjusted under 35 U.S.C. 154(b) by 110 days.

(21) Appl. No.: 13/719,250

(22) Filed: Dec. 19, 2012

(65) Prior Publication Data

US 2014/0125708 A1 May 8, 2014

(30) Foreign Application Priority Data

Nov. 8, 2012 (TW) ..... 101141671

(51) Int. Cl.
*G09G 5/10* (2006.01)
*G09G 3/34* (2006.01)

(52) U.S. Cl.
CPC ..... *G09G 3/34* (2013.01)
USPC ..... 345/690

(58) Field of Classification Search
USPC ..... 345/690, 84, 102
See application file for complete search history.

(56) References Cited

U.S. PATENT DOCUMENTS

| | | | | |
|---|---|---|---|---|
| 7,027,016 | B2 * | 4/2006 | Sakashita | 345/84 |
| 7,474,289 | B2 * | 1/2009 | Sakashita | 345/84 |
| 7,663,596 | B2 * | 2/2010 | Nam et al. | 345/102 |
| 2008/0297463 | A1 * | 12/2008 | Tsuru et al. | 345/102 |
| 2011/0149201 | A1 * | 6/2011 | Powell et al. | 349/62 |
| 2012/0154263 | A1 * | 6/2012 | Imajo et al. | 345/102 |
| 2012/0188486 | A1 * | 7/2012 | Baba et al. | 349/67 |
| 2012/0274871 | A1 * | 11/2012 | Yamazaki et al. | 349/58 |
| 2013/0120478 | A1 * | 5/2013 | Ishihara et al. | 345/690 |

* cited by examiner

*Primary Examiner* — Fred Tzeng
(74) *Attorney, Agent, or Firm* — Jianq Chyun IP Office

(57) ABSTRACT

A display device including a timing controller, a data driving circuit and a display system is provided. The timing controller outputs first pixel data according to input pixel data, wherein a color depth of the first pixel data is a first bit number or a second bit number smaller than the first bit number. The data driving circuit receives the first pixel data and a notice signal, and maps the first pixel data to generate second pixel data according to the notice signal when the color depth of the first pixel data is the second bit number, and directly takes the first pixel data as the second pixel data when the color depth of the first pixel data is the first bit number, and generates at least one driving voltage according to the second pixel data, wherein the color depth of the second pixel data is the first bit number.

26 Claims, 7 Drawing Sheets

DISPLAY DEVICE AND DATA DRIVING CIRCUIT THEREOF, DRIVING METHOD OF DISPLAY PANEL AND DISPLAY SYSTEM

CROSS-REFERENCE TO RELATED APPLICATION

This application claims the priority benefit of Taiwan application serial no. 101141671, filed on Nov. 8, 2012. The entirety of the above-mentioned patent application is hereby incorporated by reference herein and made a part of this specification.

BACKGROUND

1. Technical Field

The invention relates to an electronic device. Particularly, the invention relates to a display device, a data driving circuit thereof and a driving method of a display panel.

2. Related Art

Conventionally, a color depth of pixel data input to a display device has a fixed bit number, for example, 6 bits, and a display panel is driven through a data driving circuit. The higher the bit number (the color depth) of the pixel data is, the fine and better of a color effect of a displayed image is.

However, when a user views dynamic images, the pixel data with high bit number is not required. Regarding the dynamic images, since the images are kept changing, human eyes cannot perceive or do not pay attention to a difference of image color resolutions (for example, 6 bits and 8 bits). Compared to a static image, for example, a color picture, human eyes may perceive a great difference between a color resolution of 6 bit pixel data and a color resolution of 8 bit pixel data. Besides, when the display device transmits/processes the pixel data of a high bit number, an amount of data transmitted in internal thereof is large, which leads to a high power loss and unnecessary power consumption of the display device.

SUMMARY

The disclosure is directed to a display device, a data driving circuit thereof and a driving method of a display panel, by which a bit number (color depth) of pixel data in internal of the display device is dynamically adjusted/changed to achieve a power saving effect.

The disclosure provides a display device including a timing controller and at least one data driving circuit. The timing controller receives input pixel data and outputs first pixel data according to the input pixel data, where a color depth of the first pixel data is unfixed and varied to be a first bit number or a second bit number, and the second bit number is smaller than the first bit number. The at least one data driving circuit is coupled to the timing controller, and receives the first pixel data and a notice signal, and performs a mapping operation on the first pixel data to generate second pixel data according to the notice signal when the color depth of the first pixel data is the second bit number, and does not perform the mapping operation on the first pixel data but directly takes the first pixel data as the second pixel data when the color depth of the first pixel data is the first bit number, and generates at least one driving voltage according to the second pixel data, where a color depth of the second pixel data is fixed to the first bit number.

The disclosure provides a data driving circuit including a latch unit and a mapping unit. The latch unit receives first pixel data from a timing controller and stores the first pixel data, where a color depth of the first pixel data is unfixed and varied to be a first bit number or a second bit number, and the second bit number is smaller than the first bit number. The mapping unit is coupled to the latch unit, and receives the first pixel data stored by the latch unit, and performs a mapping operation on the first pixel data to generate second pixel data according to a notice signal when the color depth of the first pixel data is the second bit number, and does not perform the mapping operation on the first pixel data but directly takes the first pixel data as the second pixel data when the color depth of the first pixel data is the first bit number, where a color depth of the second pixel data is fixed to the first bit number.

The disclosure provides a driving method of a display panel, which includes following steps. (i) providing first pixel data to a data driving circuit according to input pixel data, where a color depth of the first pixel data is unfixed and varied to be a first bit number or a second bit number, and the second bit number is smaller than the first bit number; (ii) performing a mapping operation on the first pixel data to generate second pixel data according to a notice signal when the first pixel data is the second bit number, and generating the second pixel data without performing the mapping operation on the first pixel data when the color depth of the first pixel data is the first bit number, where a color depth of the second pixel data is fixed to the first bit number; and (iii) generating at least one driving voltage according to the second pixel data.

The disclosure provides a display system including an external system and a display device. The external system is used to output input pixel data. The display device includes a timing controller and at least one data driving circuit. The timing controller receives the input pixel data and outputs first pixel data according to the input pixel data, where a color depth of the first pixel data is unfixed and varied to be a first bit number or a second bit number, and the second bit number is smaller than the first bit number. The at least one data driving circuit is coupled to the timing controller, and receives the first pixel data and a notice signal, and performs a mapping operation on the first pixel data to generate second pixel data according to the notice signal when the color depth of the first pixel data is the second bit number, and does not perform the mapping operation on the first pixel data but directly takes the first pixel data as the second pixel data when the color depth of the first pixel data is the first bit number, and generates at least one driving voltage according to the second pixel data, where a color depth of the second pixel data is fixed to the first bit number.

In an embodiment of the invention, in the mapping operation, the data driving circuit converts the first pixel data having $2^N$-order levels into the second pixel data having $2^M$-order levels, where M is the first bit number, and N is the second bit number.

In an embodiment of the invention, the timing controller receives the input pixel data from an external system, and the timing controller further generates the notice signal to the at least one data driving circuit according to the input pixel data.

In an embodiment of the invention, the timing controller receives the input pixel data from an external system, and the at least one data driving circuit receives the notice signal from the external system.

In an embodiment of the invention, a color depth of the input pixel data is unfixed and varied to be the first bit number or the second bit number. When the color depth of the input pixel data is the first bit number, the timing controller outputs the first pixel data with the color depth of the first bit number, and when the color depth of the input pixel data is the second bit number, the timing controller outputs the first pixel data with the color depth of the second bit number.

In an embodiment of the invention, a color depth of the input pixel data is fixed to the first bit number.

In an embodiment of the invention, the timing controller determines whether to output the first pixel data with the color depth of the first bit number without executing a frame rate control or execute the frame rate control and output the first pixel data with the color depth of the second bit number according to content of the input pixel data.

In an embodiment of the invention, the timing controller includes a cyclic redundancy check unit, which receives and checks the input pixel data to obtain a check result, and outputs the notice signal to the at least one data driving circuit according to the check result.

In an embodiment of the invention, the data driving circuit includes a latch unit, a mapping unit, a digital-to-analog converter (DAC) and an output buffer unit. The latch unit receives the first pixel data from the timing controller and stores the first pixel data. The mapping unit is coupled to the latch unit, and receives the first pixel data stored by the latch unit, and performs the mapping operation on the first pixel data to generate the second pixel data according to the notice signal when the first pixel data is the second bit number, and does not perform the mapping operation on the first pixel data but directly outputs the first pixel data as the second pixel data when the first pixel data is the first bit number. The DAC is coupled to the mapping unit, and converts the second pixel data into an analog driving signal according to a reference voltage group. The output buffer unit is coupled to the DAC, and receives and gains the analog driving signal to output the at least one driving voltage.

In an embodiment of the invention, in the mapping operation, the mapping unit converts the first pixel data having $2^N$-order levels into the second pixel data having $2^M$-order levels, where M is the first bit number, and N is the second bit number.

In an embodiment of the invention, the timing controller generates the notice signal to the mapping unit.

In an embodiment of the invention, the mapping unit receives the notice signal from an external system.

In an embodiment of the invention, a color depth of the input pixel data is fixed to the first bit number.

In an embodiment of the invention, the data driving circuit further includes a DAC and an output buffer unit. The DAC is coupled to the mapping unit, and converts the second pixel data output by the mapping unit into an analog driving signal according to a reference voltage group. The output buffer unit is coupled to the DAC, and receives and gains the analog driving signal to output the at least one driving voltage.

In an embodiment of the invention, in the mapping operation, the mapping unit converts the first pixel data having $2^N$-order levels into the second pixel data having $2^M$-order levels, where M is the first bit number, and N is the second bit number.

In an embodiment of ht invention, the color depth of the input pixel data is unfixed and varied to be the first bit number or the second bit number, and when the color depth of the input pixel data is the first bit number, in the step (i), the first pixel data with the color depth of the first bit number is output, and when the color depth of the input pixel data is the second bit number, in the step (i), the first pixel data with the color depth of the second bit number is output.

In an embodiment of the invention, the color depth of the input pixel data is fixed to the first bit number, and in the step (i), it is determined whether to output the first pixel data with the color depth of the first bit number without executing a frame rate control or execute the frame rate control and output the first pixel data with the color depth of the second bit number according to content of the input pixel data.

According to the above descriptions, the mapping operation can be used to decrease the bit number of the pixel data in internal of the display device, so as to effectively decrease the data amount transmitted in the internal of the display device to save power.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

A term "couple" used in the full text of the descriptions (including the claims) refers to any direct or indirect connection means. For example, when a first device is referred to be "coupled" to a second device, it should be interpreted as that the first device is directly connected to the second device, or the first device is indirectly connected to the second device through a certain connection means. The term "signal" means at least one current, voltage, charge, data, binary, function, or other signal or indicator.

A bit number of pixel data transmitted in internal of a display device of the invention is unfixed and dynamically varied to be 6 bits, 8 bits or 10 bits. Pixel data of 6 bits or 8 bits is used in following description, though the invention is not limited thereto.

Figure 1:
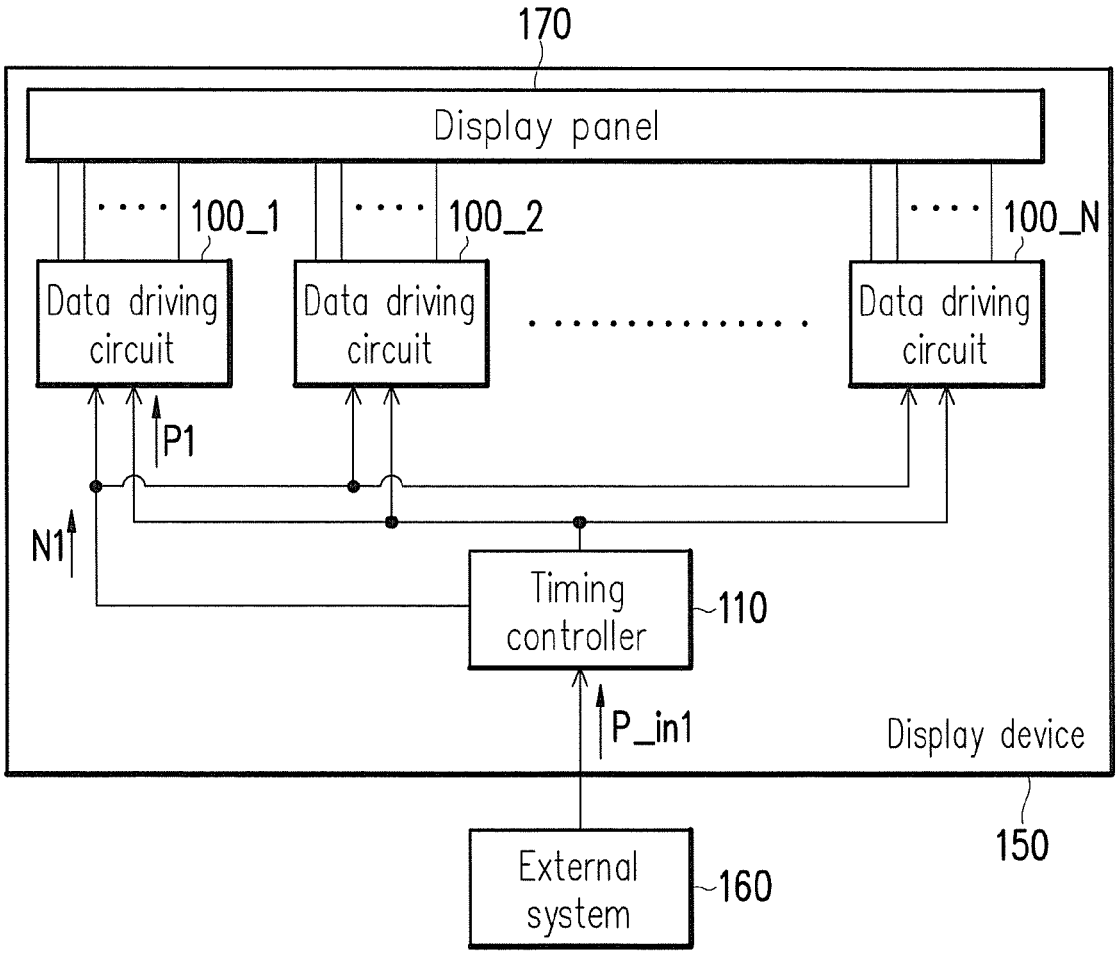
FIG. 1 is a schematic diagram of a display device according to a first embodiment of the invention.

FIG. 1 is a schematic diagram of a display device according to a first embodiment of the invention. Referring to FIG. 1, the display device 150 includes a display panel 170, a timing controller 110 and one to a plurality of data driving circuits 100_1, 100_2, . . . , 100_N. The data driving circuits 100_1-100_N are commonly coupled to the timing controller 110, and the timing controller 110 is coupled to an external system 160 outside the display device 150 for receiving input pixel data P_in1, where the external system 160 can be a host system or a system control chip, etc. In the present embodiment, a bit number of the input pixel data P_in1 is fixed to a first bit number (for example, 8 bits). The timing controller 110 outputs first pixel data P1 to each of the data driving circuits 100_1-100_N according to the input pixel data P_in1, where a color depth of the first pixel data is dynamically varied, which is, for example, a first bit number or a second bit number smaller than the first bit number. For example, in the present embodiment, the first bit number is 8 bits, and the second bit number is 6 bits. On the other hand, after the timing controller 110 receives the input pixel data P_in1, the timing controller 110 analyses the input pixel data P_in1, and determines whether or not to dynamically adjust/change the color depth of the first pixel data P1 according to an analysis result.

For example, after the timing controller 110 receives the input pixel data P_in1, the timing controller 110 determines whether the input pixel data P_in1 is dynamic image data. If the input pixel data P_in1 is static image data, since a swing of the first pixel data P1 is small (a transmission power loss is low), the timing controller 110 can output the first pixel data P1 with the color depth of 8 bits to the data driving circuits 100_1-100_N. Therefore, the display panel 170 of the display device 150 can display a fine image color effect.

Conversely, regarding dynamic images, since the images are kept changing, human eyes cannot perceive or do not pay attention to a difference between the color depth of 6 bits and the color depth of 8 bits. Therefore, when the input pixel data P_in1 is dynamic image data, the timing controller 110 can convert the input pixel data P_in1 with the color depth of 8 bits into the first pixel data P1 with the color depth of 6 bits by using use a frame rate control (FRC, which is described later) method or other method, and respectively outputs the pixel data P1 and a notice signal N1 to each of the data driving circuits 100_1-100_N, such that the data driving circuits 100_1-100_N drive the display panel 170 according to the first pixel data P1 and the notice signal N1.

Namely, according to the content of the input pixel data P_in1, the timing controller 110 determines whether to output the first pixel data P1 with the color depth of the first bit number (for example, 8 bits) without executing the frame rate control or execute the frame rate control and output the first pixel data P1 with the color depth of the second bit number (for example, 6 bits). When the input pixel data P_in1 is the dynamic image data, the timing controller 110 dynamically decreases the bit number (the color depth) of the first pixel data P1 transmitted to the data driving circuits 100_1-100_N, so as to decrease the transmission power loss.

Figure 2:
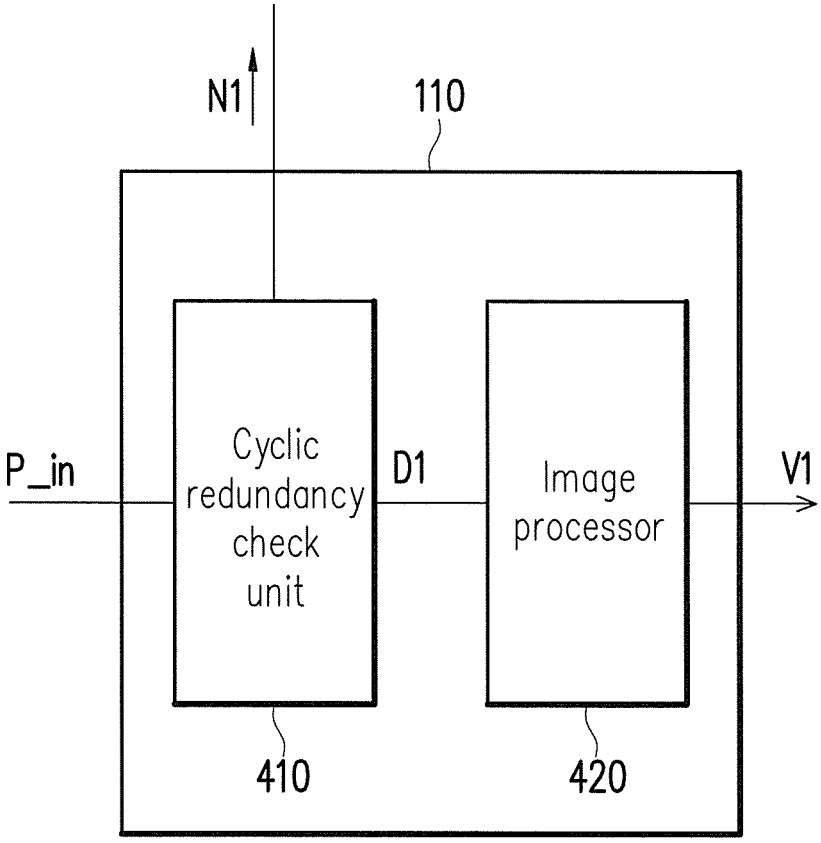
FIG. 2 is a circuit block schematic diagram of a timing controller according to an embodiment of the invention

FIG. 2 is a circuit block schematic diagram of the timing controller 110 according to an embodiment of the invention, which can be applied to the display device of the embodiment of FIG. 1, though the invention is not limited thereto. Referring to FIG. 2, the timing controller 100 includes a cyclic redundancy check unit 410 and an image processor 420. The cyclic redundancy check unit 410 receives and checks input pixel data P_in (for example, the input pixel data P_in1 of FIG. 1 or input pixel data P_in2 of FIG. 5) to obtain a check result, and outputs the notice signal N1 to the data driving circuits 100_1-100_N according to the check result. For example, the cyclic redundancy check unit 410 receives the input pixel data P_in, and compares/checks a cyclic redundancy check value of different frame in the input pixel data P_in. If the cyclic redundancy check values of the different frames have an obvious variation or an variation to a predetermined extent, the cyclic redundancy check unit 410 determines the input pixel data P_in to be a dynamic image, and outputs the notice signal N1.

Moreover, in case of the embodiment of FIG. 1, when the cyclic redundancy check unit 410 determines the input pixel data P_in to be the dynamic image, the image processor 420 of the timing controller 110 may convert the input pixel data P_in with the color depth of 8 bits (i.e. the input pixel data P_in1 of FIG. 1) into the first pixel data P1 with the color depth of 6 bits by using use the frame rate control method. However, it should be noticed that in other embodiments, for example, the embodiment of FIG. 5 (which is described later), regardless of whether the input pixel data P_in is a dynamic image or a static image, when the image processor 420 performs image processing on the input pixel data P_in, it does not convert the color depth of the input pixel data P_in, and outputs the first pixel data P1 having the bit number (color depth) the same as that of the input pixel data P_in.

Figure 3:
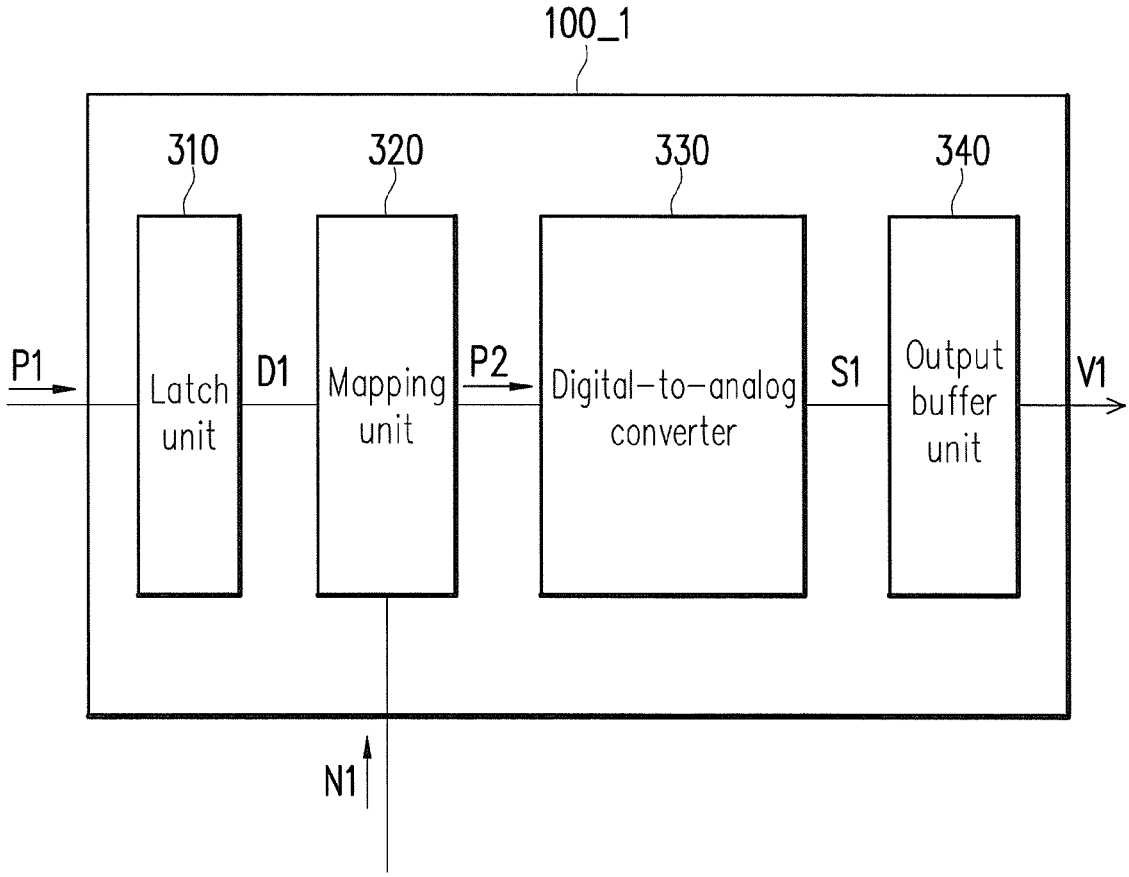
FIG. 3 is a circuit block schematic diagram of a data driving circuit according to an embodiment of the invention

FIG. 3 is a circuit block schematic diagram of the data driving circuit 100_1 according to an embodiment of the invention, which can be applied to the display device of the embodiment of FIG. 1, though the invention is not limited thereto. Implementation details of only the data driving circuit 100_1 is illustrated in FIG. 3, and implementations of the other data driving circuit 100_2-100_N can be deduced according to related description of the data driving circuit 100_1.

Referring to FIG. 3, the data driving circuit 100_1 includes a latch unit 310, a mapping unit 320, a digital-to-analog converter (DAC) 330 and an output buffer unit 340. First, the latch unit 310 receives and latches the first pixel data P1 input to the data driving circuit 100_1 from the timing controller 110 to serve as latch data D1, and outputs the latch data D1 to the mapping unit 320. The mapping unit 320 coupled to the latch unit 310 receives the latch data D1, and determines whether or not to perform a mapping operation (which is described later) on the latch data D1 (i.e. the first pixel data P1 stored by the latch unit 310) according to the notice signal N1. For example, in the mapping operation, the data driving circuit 100_1 converts the first pixel data P1 having a $2^N$-order level into second pixel data P2 having a $2^M$-order level, where M is the first bit number (for example, 8 bits), and N is the second bit number (for example, 6 bits). The notice signal N1 can be provided by the timing controller 110 of FIG. 1 or FIG. 5. In other embodiments, for example, the embodiment of FIG. 6 or FIG. 7 (which are described later), the notice signal N1 can be provided by the external system 160.

Referring to FIG. 3, when the color depth of the first pixel data P1 has the second bit number (for example, 6 bits), the mapping unit 320 performs the mapping operation (which is described later) on the latch data D1 (i.e. the first pixel data P1 stored in the latch unit 310) to generate the second pixel data P2 with the color depth of the first bit number (for example, 8 bits) according to the notice signal N1; when the color depth of the first pixel data P1 has the first bit number (for example, 8 bits), the mapping unit 320 does not perform the mapping operation (which is described later) on the latch data D1 (i.e. the first pixel data P1 stored in the latch unit 310), but directly outputs the latch data D1 as the second pixel data P2 with the bit number of 8 bits. Then, the DAC 330 coupled to the mapping unit 320 converts the second pixel data P2 of a digital type into an analog driving signal S1 according to a reference voltage group (for example, a GAMMA voltage group). The output buffer unit 340 coupled to the DAC 330 receives and gains the analog driving signal S1 to output at least one driving voltage V1 to the display panel 170.

Figure 4:
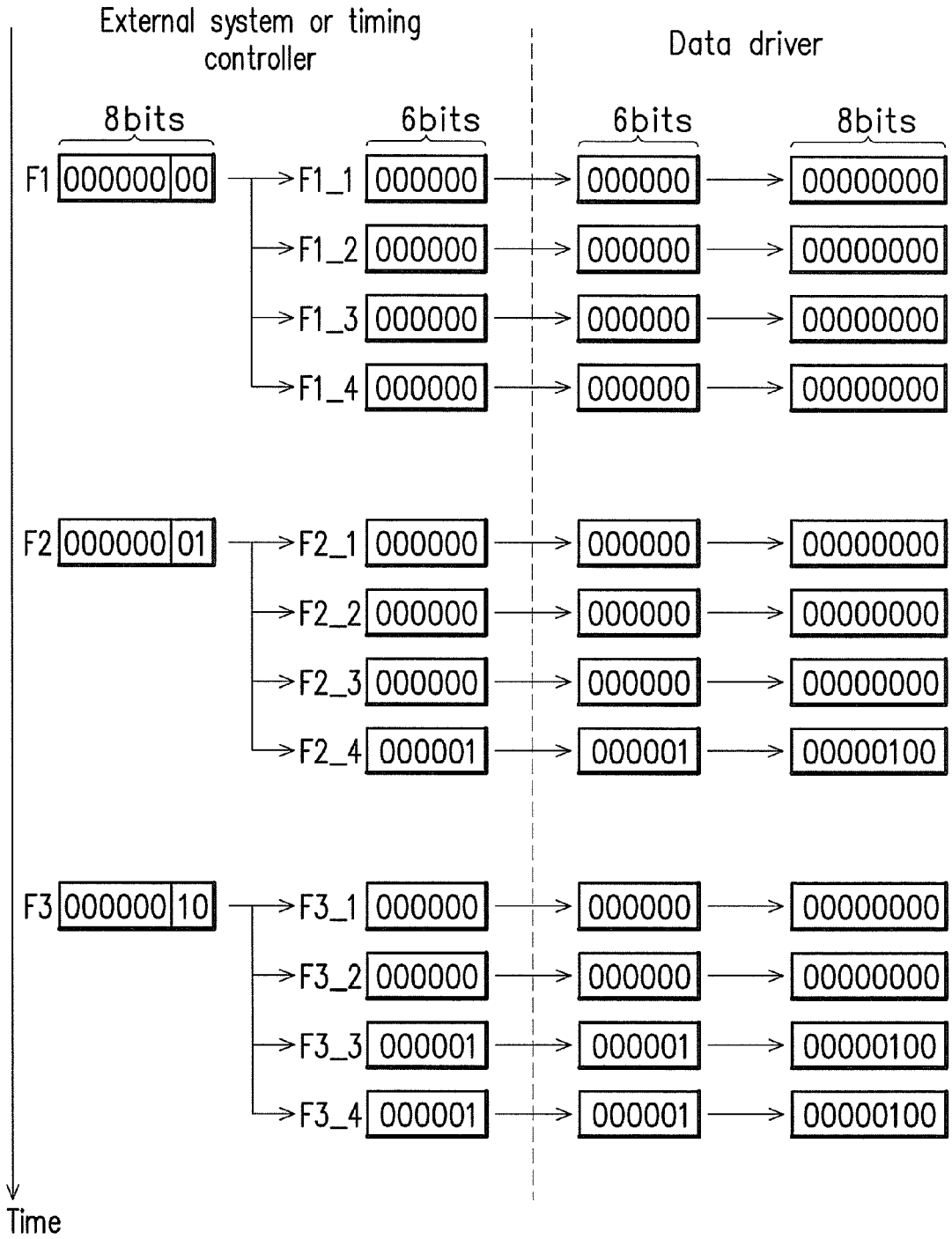
FIG. 4 is a schematic diagram of a frame rate control method according to an embodiment of the invention.

FIG. 4 is a schematic diagram of a frame rate control method according to an embodiment of the invention. The frame rate control in the embodiments of FIG. 1, FIG. 5, FIG. 6 and FIG. 7 can be deduced according to related description of FIG. 4. In some embodiments, for example, the embodiment of FIG. 1 or the embodiment of FIG. 6 (which is described later), the timing controller 110 performs the frame rate control shown in a left part of FIG. 4 to convert pixel data with the color depth of the first bit number (for example, 8 bits) into pixel data with the color depth of the second bit number (for example, 6 bits). Frame rate control of the other pixel data can be deduced according to the description of FIG.

4. In some other embodiments, for example, the embodiment of FIG. 5 or FIG. 7 (which is described later), the frame rate control shown in the left part of FIG. 4 is executed by the external system 160.

Referring to FIG. 1, FIG. 3 and FIG. 4, taking a frame period F1 as an example, if the input pixel data P_in1 of 8 bits is "00000000", the timing controller 110 can extract last two bits "00" of "00000000" to serve as a frame rate control parameter, and right-shifts "00000000" by two bits to serve as first frame rate control data. Pixel data greater than the first frame rate control data by one gray level is selected as second frame rate control data. For example, if the first frame rate control data is "000000", the second frame rate control data is "000001". According to the frame rate control parameter, the timing controller 110 respectively selects to transmit the first frame rate control data or the second frame rate control data to serve as the first pixel data P1 during sub-frame periods F1_1, F1_2, F1_3 and F1_4. For example, as shown in FIG. 4, according to the frame rate control parameter "00", the timing controller 110 sequentially selects to transmit pixel data "000000", "000000", "000000" and "000000" to the data driving circuits 100_1-100_N to serve as the first pixel data P1 during sub-frame periods F1_1, F1_2, F1_3 and F1_4.

The right part of FIG. 4 illustrates an example that the data driving circuit (for example, 100_1) performs the mapping operation. When the notice signal N1 indicates that the frame rate control has been performed, the mapping unit 320 of the data driving circuit 100_1 performs the mapping operation to convert the received first pixel data P1 (with the color depth of 6 bits) into the second pixel data P2 (with the color depth of 8 bits). For example, the mapping unit 320 of the data driving circuit 100_1 can respectively left-shift the pixel data "000000" by two bits during the sub-frame periods F1_1, F1_2, F1_3 and F1_4 to obtain pixel data "00000000".

Taking a frame period F2 as an example, if the input pixel data P_in 1 of 8 bits is "00000001", the timing controller 110 can extract last two bits "01" of "00000001" to serve as a frame rate control parameter, and right-shifts "00000001" by two bits to serve as the first frame rate control data. Therefore, the second frame rate control data is "000001". As shown in FIG. 2, according to the frame rate control parameter "01", the timing controller 110 sequentially selects to transmit pixel data "000000", "000000", "000000" and "000001" to the data driving circuits 100__1-100_N to serve as the first pixel data P1 during sub-frame periods F2_1, F2_2, F2_3 and F2_4. The mapping unit 320 of the data driving circuit 100_1 performs the mapping operation according to the notice signal N1 to respectively left-shift the pixel data "000000", "000000", "000000" and "000001" received during the sub-frame periods F2_1, F2_2, F2_3 and F2_4 by two bits, so as to respectively obtain pixel data "00000000", "00000000", "00000000" and "00000100" with the color depth of 8 bits. Therefore, by mixing color in a temporal domain, the display panel 170 of the display device 150 can display a color/gray level between "00000000" and "00000100", i.e. the color/gray level of "00000001".

Deduced by analogy, during a frame period of F3, if the input pixel data P_in1 of 8 bits is "00000010", the timing controller 110 respectively selects to transmit pixel data "000000", "000000", "000001" and "000001" to the data driving circuits 100_1-100_N to serve as the first pixel data P1 during sub-frame periods F3_1, F3_2, F3_3 and F3_4. The mapping unit 320 performs the mapping operation according to the notice signal N1 to respectively left-shift the pixel data "000000", "000000", "000001" and "000001" received during the sub-frame periods F3_1, F3_2, F3_3 and F3_4 by two bits, so as to respectively obtain pixel data "00000000", "00000100" and "00000100" with the color depth of 8 bits. Therefore, the display panel 170 of the display device 150 can display a color/gray level between "00000000" and "00000100", i.e. the color/gray level of "00000010".

In other embodiments, the arranged sequences of the first frame rate control data and the second frame rate control data during the four sub-frame periods are not limited to the sequences shown in FIG. 4. For example, in another embodiment, if the input pixel data P_in1 of 8 bits is "00000010" during the frame period F3, the timing controller 110 sequentially selects to transmit pixel data "000000", "000001", "000000" and "000001" to the data driving circuits 100_1-100_N to serve as the first pixel data P1 during sub-frame periods F3_1, F3_2, F3_3 and F3_4.

Figure 5:
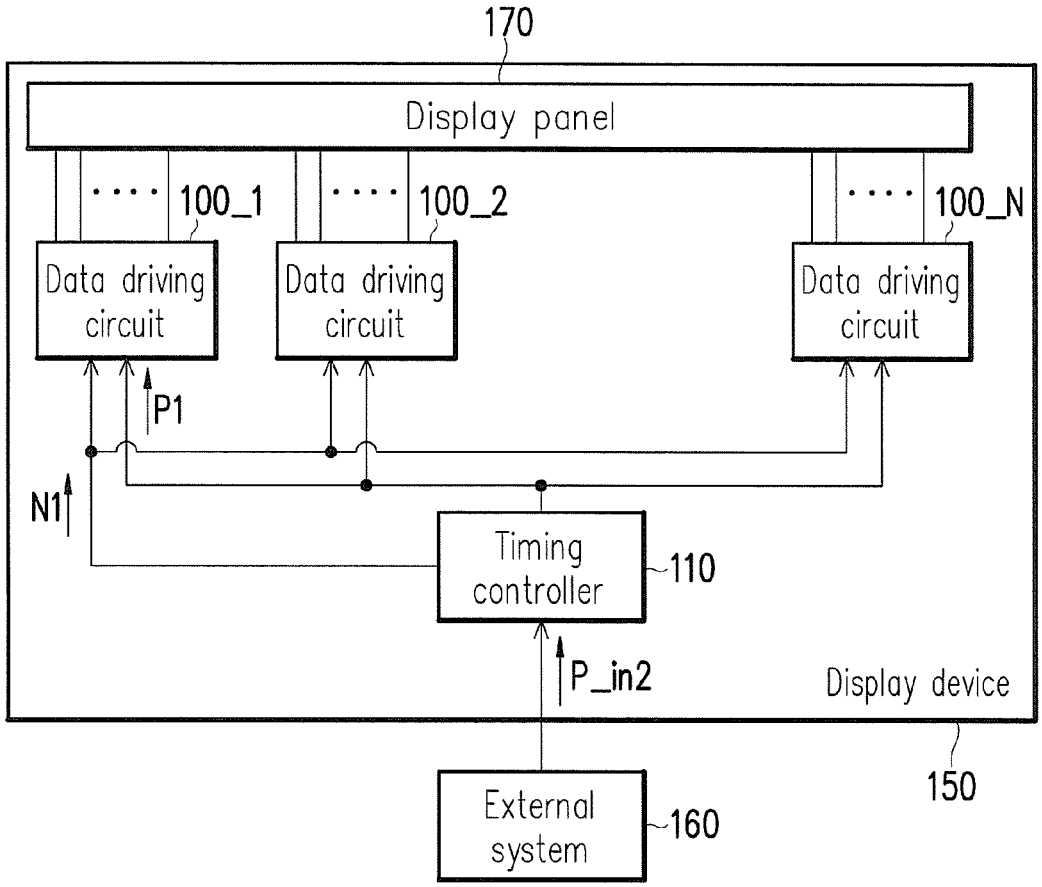
FIG. 5 is a circuit block schematic diagram of a display device according to a second embodiment of the invention.

FIG. 5 is a circuit block schematic diagram of a display device according to a second embodiment of the invention. Implementation of the display device 150 of FIG. 5 can be deduced according to related description of the first embodiment of FIG. 1. Different to the first embodiment of FIG. 1, in the embodiment of FIG. 5, the color depth of the input pixel data P_in2 is the first bit number (for example, 8 bits) or the second bit number (for example, 6 bits). Namely, the external system 160 determines in advance whether the processed pixel data (for generating the input pixel data P_in2) is dynamic image data, and convert the input pixel data with the color depth of the first bit number (for example, 8 bits) into the input pixel data P_in2 with the color depth of the second bit number by using use the frame rate control method (shown in FIG. 4). After the timing controller 110 receives the input pixel data P_in2, the timing controller 110 checks the input pixel data P_in2 to obtain a check result, and outputs the notice signal N1 to the data driving circuits 100_1-100_N according to the check result. In the embodiment of FIG. 5, regardless of whether the input pixel data P_in2 is a dynamic image or a static image, the timing controller 110 does not perform the frame rate control, and outputs the first pixel data P1 having the bit number (color depth) the same as that of the input pixel data P_in2 to the data driving circuits 100_1-100_N. Each of the data driving circuits 100_1-100_N drives the display panel 170 according to the pixel data P1 and the notice signal N1.

Figure 6:
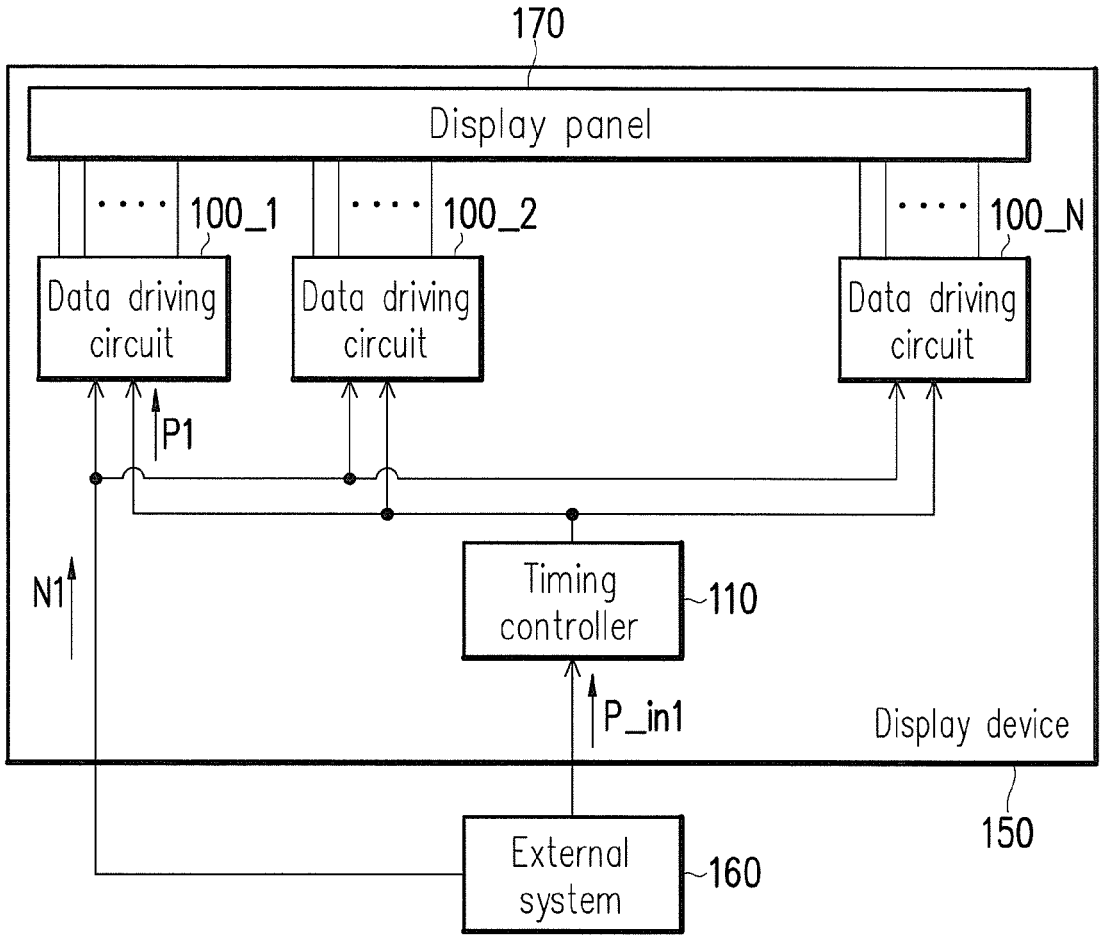
FIG. 6 is a circuit block schematic diagram of a display device according to a third embodiment of the invention.

FIG. 6 is a circuit block schematic diagram of a display device according to a third embodiment of the invention. Implementation of the display device 150 of FIG. 6 can be deduced according to related description of the first embodiment of FIG. 1. Different to the first embodiment of FIG. 1, in the embodiment of FIG. 6, each of the data driving circuits 100_1-100_N respectively receives the notice signal N1 from the external system 160 rather than from the timing controller 110. Referring to FIG. 6, the external system 160 determines in advance whether the processed pixel data (for generating the input pixel data P_in1) is dynamic image data, and sends the notice signal N1 to each of the data driving circuits 100_1-100_N according to a determination result. In the embodiment of FIG. 6, regardless of whether the input pixel data P_in1 is a dynamic image or a static image, the external system 160 does not perform the frame rate control, and outputs the input pixel data P_in1 with the color depth of the first bit number to the timing controller 110. After the timing controller 110 receives the input pixel data P_in1, the timing controller 110 checks the input pixel data P_in1 to obtain a check result, and determines whether to perform the frame rate control method (shown in FIG. 4) according to the check result, so as to convert the input pixel data P_in1 with the color depth of the first bit number (for example, 8 bits) into the first pixel data P1 with the color depth of the second bit number (for example, 6 bits). Each of the data driving circuit 100_1-100_N drives the display panel 170 according to the first pixel data P1 and the notice signal N1.

Figure 7:
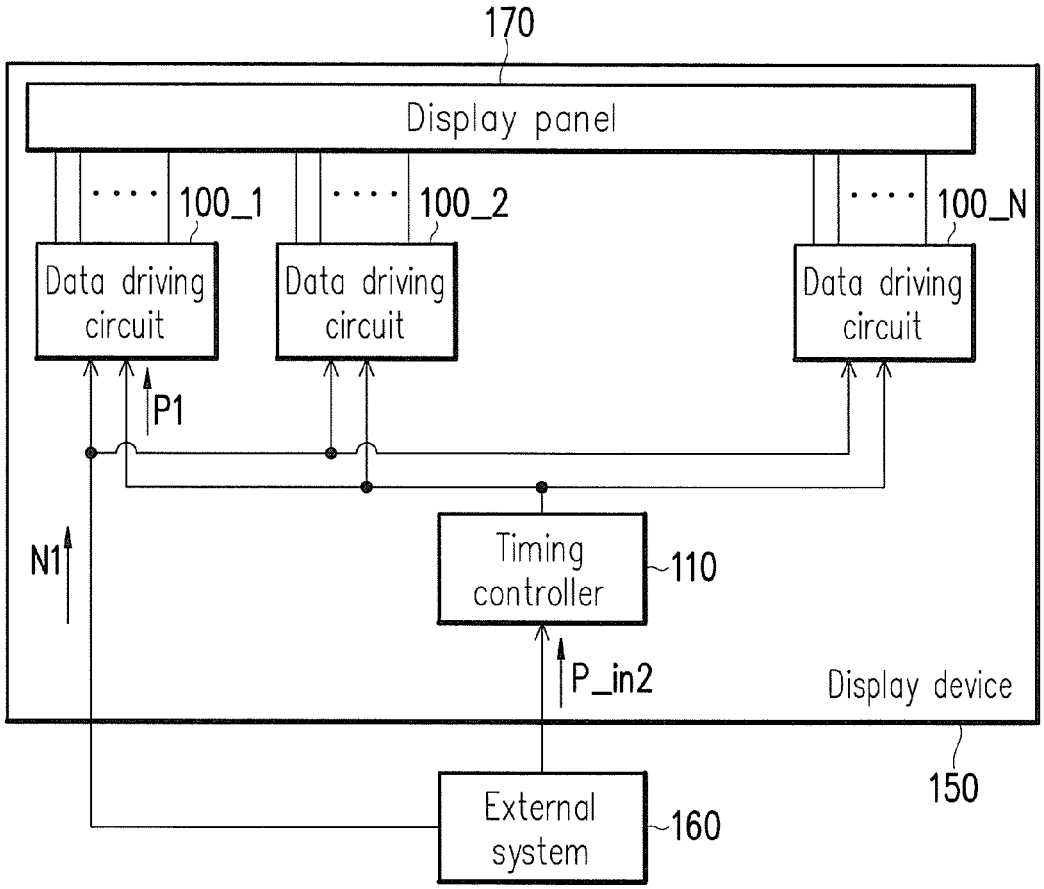
FIG. 7 is a circuit block schematic diagram of a display device according to a fourth embodiment of the invention.

FIG. 7 is a circuit block schematic diagram of a display device according to a fourth embodiment of the invention. Implementation of the display device 150 of FIG. 7 can be deduced according to related description of FIG. 5. Different to the second embodiment of FIG. 5, in the embodiment of FIG. 7, each of the data driving circuits 100_1-100_N respectively receives the notice signal N1 from the external system 160 rather than from the timing controller 110. Referring to FIG. 7, in the present embodiment, the timing controller 110 does not perform the frame rate control. The external system 160 determines in advance whether the processed pixel data (for generating the input pixel data P_in2) is dynamic image data, and sends the notice signal N1 to each of the data driving circuits 100_1-100_N according to a determination result. The external system 160 also determines whether to perform the frame rate control (shown in FIG. 4) according to the determination result, so as to convert the pixel data with the color depth of the first bit number (for example, 8 bits) into the input pixel data P_in2 with the color depth of the second bit number (for example, 6 bits). Therefore, the color depth of the input pixel data P_in2 can be the first bit number (for example, 8 bits) or the second bit number (for example, 6 bits). Each of the data driving circuit 100_1-100_N drives the display panel 170 according to the first pixel data P1 and the notice signal N1.

According to the above embodiments, the notice signal can be generated by the external system or the timing controller. Moreover, the frame rate control or adjusting of the color depth can be performed by the external system or the timing controller. Therefore, there is a plurality of implementations of different combinations.

It should be noticed that in the aforementioned embodiments, although the color depth of the first pixel data P1 is dynamically changed to the first bit number or the second bit number, in other embodiments, the first pixel data P1 can be dynamically changed to more different bit numbers. Regarding the first pixel data P1 corresponding to different bit numbers, the external system or the timing controller can implement control in a similar manner, such that data driving circuit can opportunely select to perform or not to perform the mapping operation between different bit numbers, so as to reduce the power consumption in internal of the display device.

In summary, in the display device of the disclosure, it is determined whether the currently displayed image is a dynamic image, and the frame rate control method or other method may be used to decrease the amount of data transmitted in internal of the display device, and based on the mapping operation of the data driving circuit, the dynamic images can be played though low bit pixel data, so as to decrease the power consumption of the display device.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A display device, comprising:

a timing controller, receiving input pixel data and outputting first pixel data according to the input pixel data, wherein a color depth of the first pixel data is unfixed and varied to be a first bit number or a second bit number, and the second bit number is smaller than the first bit number; and at least one data driving circuit, coupled to the timing controller, and receiving the first pixel data and a notice signal, and performing a mapping operation on the first pixel data to generate second pixel data according to the notice signal when the color depth of the first pixel data is the second bit number, and not to perform the mapping operation on the first pixel data but directly taking the first pixel data as the second pixel data when the color depth of the first pixel data is the first bit number, and generating at least one driving voltage according to the second pixel data, wherein a color depth of the second pixel data is fixed to the first bit number.

2. The display device as claimed in claim 1, wherein in the mapping operation, the data driving circuit converts the first pixel data having $2^N$-order levels into the second pixel data having $2^M$-order levels, wherein M is the first bit number, and N is the second bit number.

3. The display device as claimed in claim 1, wherein the timing controller receives the input pixel data from an external system, and the timing controller further generates the notice signal to the at least one data driving circuit according to the input pixel data.

4. The display device as claimed in claim 1, wherein the timing controller receives the input pixel data from an external system, and the at least one data driving circuit receives the notice signal from the external system.

5. The display device as claimed in claim 1, wherein a color depth of the input pixel data is unfixed and varied to be the first bit number or the second bit number, the timing controller outputs the first pixel data with the color depth of the first bit number when the color depth of the input pixel data is the first bit number, and the timing controller outputs the first pixel data with the color depth of the second bit number when the color depth of the input pixel data is the second bit number.

6. The display device as claimed in claim 1, wherein a color depth of the input pixel data is fixed to the first bit number.

7. The display device as claimed in claim 6, wherein the timing controller determines whether to output the first pixel data with the color depth of the first bit number without executing a frame rate control or output the first pixel data with the color depth of the second bit number by executing the frame rate control according to content of the input pixel data.

8. The display device as claimed in claim 1, wherein the timing controller comprises a cyclic redundancy check unit, and the cyclic redundancy check unit receives and checks the input pixel data to obtain a check result, and outputs the notice signal to the at least one data driving circuit according to the check result.

9. The display device as claimed in claim 1, wherein the data driving circuit comprises:

a latch unit, receiving the first pixel data from the timing controller and storing the first pixel data;

a mapping unit, coupled to the latch unit, receiving the first pixel data stored by the latch unit, and performing the mapping operation on the first pixel data to generate the second pixel data according to the notice signal when the color depth of the first pixel data is the second bit number, and not to perform the mapping operation on the first pixel data but outputting the first pixel data as the second pixel data when the color depth of first pixel data is the first bit number;

a digital-to-analog converter, coupled to the mapping unit, and converting the second pixel data into an analog driving signal according to a reference voltage group; and an output buffer unit, coupled to the digital-to-analog converter, and receiving and gaining the analog driving signal to output the at least one driving voltage.

10. A data driving circuit, comprising:

a latch unit, receiving first pixel data from a timing controller and storing the first pixel data, wherein a color depth of the first pixel data is unfixed and varied to be a first bit number or a second bit number, and the second bit number is smaller than the first bit number; and a mapping unit, coupled to the latch unit, and receiving the first pixel data stored by the latch unit, and performing a mapping operation on the first pixel data to generate second pixel data according to a notice signal when the color depth of the first pixel data is the second bit number, and not to perform the mapping operation on the first pixel data but taking the first pixel data as the second pixel data when the color depth of the first pixel data is the first bit number, wherein a color depth of the second pixel data is fixed to the first bit number.

11. The data driving circuit as claimed in claim 10, wherein in the mapping operation, the mapping unit converts the first pixel data having $2^N$-order levels into the second pixel data having $2^M$-order levels, where M is the first bit number, and N is the second bit number.

12. The data driving circuit as claimed in claim 10, wherein the timing controller generates the notice signal to the mapping unit.

13. The data driving circuit as claimed in claim 10, wherein the mapping unit receives the notice signal from an external system.

14. The data driving circuit as claimed in claim 10, further comprising:

a digital-to-analog converter, coupled to the mapping unit, and converting the second pixel data output by the mapping unit into an analog driving signal according to a reference voltage group; and an output buffer unit, coupled to the digital-to-analog converter, and receiving and gaining the analog driving signal to output at least one driving voltage.

15. A driving method of a display panel, comprising:

(i) providing first pixel data to a data driving circuit according to input pixel data, wherein a color depth of the first pixel data is unfixed and varied to be a first bit number or a second bit number, and the second bit number is smaller than the first bit number;

(ii) performing a mapping operation on the first pixel data to generate second pixel data according to a notice signal when the first pixel data is the second bit number, and generating the second pixel data without performing the mapping operation on the first pixel data when the color depth of the first pixel data is the first bit number, wherein a color depth of the second pixel data is fixed to the first bit number; and (iii) generating at least one driving voltage according to the second pixel data.

16. The driving method of the display panel as claimed in claim 15, wherein in the mapping operation, the first pixel data having $2^N$-order levels is converted into the second pixel data having $2^M$-order levels, wherein M is the first bit number, and N is the second bit number.

17. The driving method of the display panel as claimed in claim 15, wherein the color depth of the input pixel data is unfixed and varied to be the first bit number or the second bit number, and the first pixel data with the color depth of the first bit number is output in the step (i) when the color depth of the input pixel data is the first bit number, and the first pixel data with the color depth of the second bit number is output in the step (i) when the color depth of the input pixel data is the second bit number.

18. The driving method of the display panel as claimed in claim 15, wherein the color depth of the input pixel data is fixed to the first bit number, and in the step (i), it is determined whether to output the first pixel data with the color depth of the first bit number without executing a frame rate control or output the first pixel data with the color depth of the second bit number by executing the frame rate control according to content of the input pixel data.

19. A display system, comprising:

an external system, outputting input pixel data; and a display device, comprising:

a timing controller, receiving the input pixel data and outputting first pixel data according to the input pixel data, wherein a color depth of the first pixel data is unfixed and varied to be a first bit number or a second bit number, and the second bit number is smaller than the first bit number; and at least one data driving circuit, coupled to the timing controller, and receiving the first pixel data and a notice signal, and performing a mapping operation on the first pixel data to generate second pixel data according to the notice signal when the color depth of the first pixel data is the second bit number, and not to perform the mapping operation on the first pixel data but directly taking the first pixel data as the second pixel data when the color depth of the first pixel data is the first bit number, and generating at least one driving voltage according to the second pixel data, wherein a color depth of the second pixel data is fixed to the first bit number.

20. The display system as claimed in claim 19, wherein in the mapping operation, the data driving circuit converts the first pixel data having $2^N$-order levels into the second pixel data having $2^M$-order levels, wherein M is the first bit number, and N is the second bit number.

21. The display system as claimed in claim 19, wherein the timing controller generates the notice signal to the at least one data driving circuit according to the input pixel data.

22. The display system as claimed in claim 19, wherein the external system generates the notice signal to the at least one data driving circuit according to pixel data processed by the external system.

23. The display system as claimed in claim 19, wherein the external system determines whether to output the input pixel data with a color depth of the first bit number without executing a frame rate control or output the input pixel data with the color depth of the second bit number by executing the frame rate control according to content of pixel data processed by the external system.

24. The display system as claimed in claim 23, wherein the timing controller outputs the first pixel data with the color depth of the first bit number when the color depth of the input pixel data is the first bit number, and the timing controller outputs the first pixel data with the color depth of the second bit number when the color depth of the input pixel data is the second bit number.

25. The display system as claimed in claim 19, wherein the external system outputs the input pixel data with the color depth fixed to the first bit number.

26. The display system as claimed in claim 25, wherein the timing controller determines whether to output the first pixel data with the color depth of the first bit number without executing a frame rate control or output the first pixel data with the color depth of the second bit number by executing the frame rate control according to content of the input pixel data.

* * * * *